United States Patent [19]

Bloom

[11] 4,291,471

[45] Sep. 29, 1981

[54] EXHAUST SYSTEM AND METHOD FOR VENTING A TUNNEL KILN

[75] Inventor: Terry R. Bloom, Middlebury, Ind.

[73] Assignee: CTS Corporation, Elkhart, Ind.

[21] Appl. No.: 132,093

[22] Filed: Mar. 20, 1980

[51] Int. Cl.[3] ..... F26B 21/00

[52] U.S. Cl. ..... 34/12; 34/13; 34/151; 34/148; 34/216; 34/217; 34/72; 98/36; 432/72

[58] Field of Search ..... 34/4, 39–41, 34/66, 67, 155, 77, 76, 79, 85, 216, 217, 12, 13, 148; 432/72; 118/61, 733; 98/36, 115 R

[56] References Cited

U.S. PATENT DOCUMENTS

| | | | |
|---|---|---|---|
| 1,069,033 | 7/1913 | Rowland | 118/61 |
| 2,921,778 | 1/1960 | Ruff | 432/72 |
| 3,228,113 | 1/1966 | Fannon, Jr. | 34/39 |
| 3,513,765 | 5/1970 | Bok | 98/115 |
| 3,659,551 | 5/1972 | McKinstry | 34/242 |
| 3,834,293 | 9/1974 | Danieli | 98/36 |

*Primary Examiner*—Larry I. Schwartz
*Attorney, Agent, or Firm*—Larry J. Palguta; John A. Young

[57] ABSTRACT

A lateral exhaust manifold system for the preheat section of a tunnel kiln comprises a longitudinal duct and input tube. The duct is triangular in shape and has a plurality of spaced apart apertures and a corresponding plurality of cones, the large diameter end of each cone circumposing a respective one of said apertures. The input tube is disposed adjacent the opposite side of the tunnel kiln and has a plurality of spaced apart jets each disposed opposite a respective aperture in the longitudinal duct, and a plurality of spaced apart apertures each located intermediate the jets, the spaced apart apertures and for venting air laterally across the kiln and upwardly along the adjacent wall. A blower vents an exhaust stack connected to an end of the duct. Air curtains control the entrance and exit of the preheat section of the kiln. Pressurized air is sent into the input tube and exits laterally and vertically into the preheat section of the tunnel kiln, and thereafter enters the duct through the duct apertures and cones. The blower creates a partial vacuum in the duct which gathers in the air moving laterally across the kiln thereby venting to atmosphere organics which escape or are emitted from paints being heated in the preheat section of the kiln.

10 Claims, 4 Drawing Figures

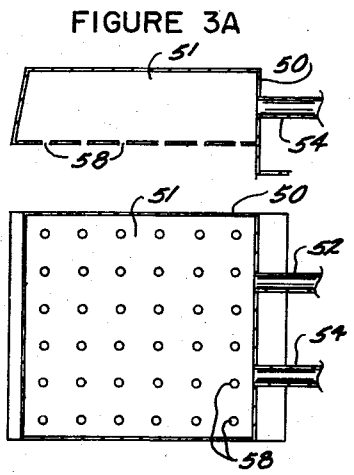
FIGURE 3A
FIGURE 3B
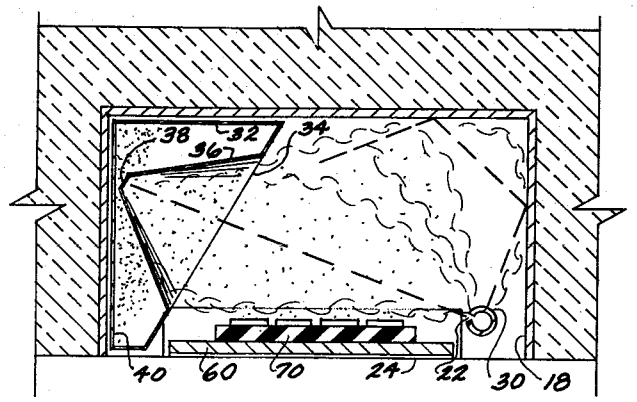
FIGURE 2
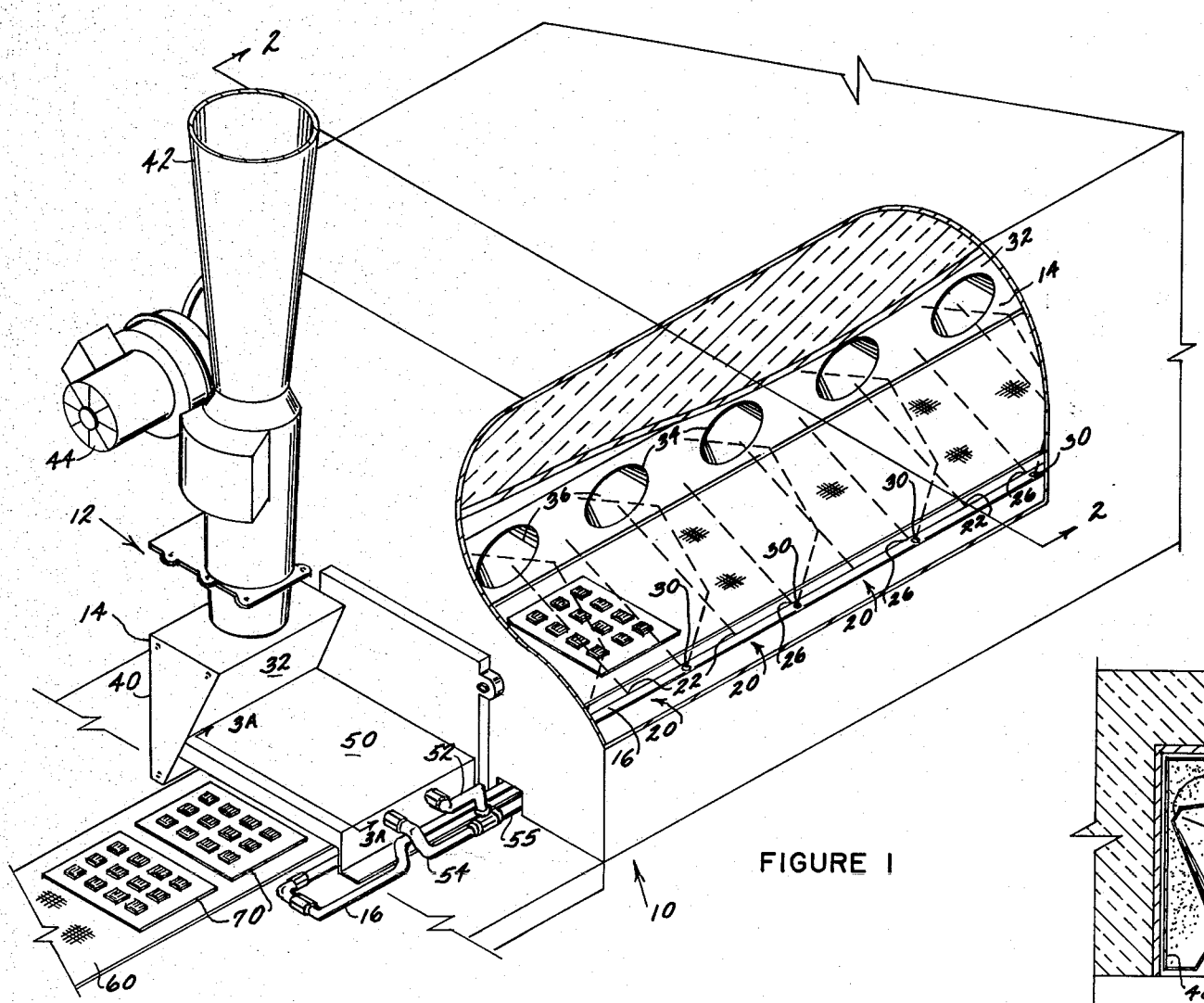
FIGURE 1

EXHAUST SYSTEM AND METHOD FOR VENTING A TUNNEL KILN

BACKGROUND OF THE INVENTION

There are many manufacturing facilities in the United States which utilize production tunnel kilns of the type comprising a preheat section and a firing section. These production tunnel kilns have a conveyor belt which passes longitudinally through the kiln. Carried on the conveyor belt are a plurality of boards. On the boards are substrates having a paint screened thereon and the boards are carried into the preheat portion of the kiln wherein the temperature is raised to approximately 600 degrees. The preheat section of the kiln removes volatile organic material that is emitted or escapes from the paints. The boards and substrates then pass into the firing section of the kiln where the firing temperature is approximately 800° C. or higher and the materials are cured. In the prior art, there have been considerable problems with cross-contamination which occurs when a board has substrates with a paint different than the paint on substrates on preceding boards. In other words, boards with "wet" paints first pass through the preheat section of the kiln and are raised to a temperature which removes volatile organics from the paints. Volatile organics remaining in the atmosphere can contaminate different paints which subsequently appear on successive boards. In the prior art, this cross-contamination of different types of paints has prompted attempts to vent or remove the contaminated atmosphere from the preheat section of the kiln. This has been done in generally one of two ways, either by forcing a co-flow or counter-flow of purging air longitudinally throughout the preheat section of the kiln. A co-flow venting system forces air longitudinally through the oven in the same direction as the conveyor belt moves, and a counter-flow venting system passes air counter to the direction of movement of the conveyor belt. Both systems attempt to create a turbulence in the air, and attempt to eliminate laminar air flow in order that the volatile organics can be vented at one end or the other of the preheat section of the kiln, depending on the type of venting system being used. Such venting systems have proved ineffective because turbulent air flow is not created throughout the length of the kiln. Turbulence generally does not occur in the prior proposals throughout the center portion of the kiln section. There frequently remains a laminar type air flow at the center kiln section. This laminar flow at the center section of the preheat oven permits the volatile organics to remain in the kiln atmosphere where they come into contact with subsequent boards having different paints passing through the kiln.

Another method that has been attempted in order to eliminate contaminated atmosphere from the preheat section of the kiln, is to have a number of consecutive boards with no substrates thereon so that there will be a gap between the different types of paints on substrates passing through the kiln. This has been done by having as many as 20 empty boards pass through the preheat section before a new group of substrates having a different paint enter the preheat section. Obviously, this has a great effect upon the yield capacity of a kiln and is highly unsatisfactory for economical production methods. Therefore, it would be desirable to provide an atmospheric purging system for the kiln interior which would effectively remove volatile organics contaminating the atmosphere, and which would improve the yield capacity of a kiln by allowing different paints to pass through the kiln without contamination occurring and with a maximum number of painted substrates passing through the oven during its operational period.

Another problem created by kilns which do not effectively vent contaminated atmosphere, is the inability to track effectively the temperature coefficient of resistance (TCR) of fired resistors in order that the resistors meet customer specifications. Manufacturers must be able to produce fired resistors that meet specifications requiring not only a particular fired resistance value and an overall TCR range but which also require a specified TCR tracking value (TCRTV). The TCR tracking value (TCRTV) may be defined as the difference between the changed resistance values of resistors as the ambient and operational temperatures of each resistor varies during operational use, such a change having a grossly distorting effect on the circuitry. It is highly desirable that as the temperature of the resistors change during operation, and the respective resistance values change, the resistance values change at approximately the same rate so that the resulting differential between the changed resistance values and thus the output characteristics of the resistors or network of resistors remain as consistent or controlled as possible. The match of initial fired resistance values must be viewed as important not only from a static viewpoint but from a dynamic viewpoint. A different rate of change in resistance values of the respective resistors or networks can alter undesirably the differential (TCRTV) between the respective changed resistance values and thus the overall output characteristics.

The TCR of a fired resistor is dependent upon or reflects the fired resistance value of the resistor, and correspondingly, the TCRTV also reflects the fired resistance value of the resistor. Thus, if resistors have a divergence of resistance values after sintering in the firing section of the kiln, the TCR and TCR tracking values of the resistors tends to have a corresponding divergence and the customers specifications are not obtained. Thus, the match of initial fired resistor values is important, but equally important is a continued match during change in ambient and operational temperatures so that this match is a dynamic match remaining equivalent at all equilibrium temperatures as well as at initial temperatures. If there is contamination, there tends to be a disfunction of match thereby making an effective kiln exhaust system all the more important. Therefore, it is desirable to increase the quality of resistors produced by a tunnel kiln firing procedure by improving the consistency of fired resistance values obtained, thereby lending to an improved consistency of TCR values which will tend to result in a smaller differential in changed fired resistance values and lead to an improved TCRTV.

SUMMARY OF THE INVENTION

It is an object of the present invention to develop a system which effectively and efficiently cleans the atmosphere of the preheat section of a kiln by removing the volatizable fractions of the paints on substrates.

Another object of this invention is to remove contaminating atmosphere from the preheat section of production tunnel kiln by utilizing a lateral purging system which removes the contaminating atmosphere from the kiln interior.

It is a further object of this invention to develop an atmospheric purging system which effectively and efficiently removes contaminating atmosphere from the preheat section of a production tunnel kiln in order that different paints can be fired one after another and be free of their contaminating effect one upon the other while each of the different boards pass through the preheat section without requiring a gap between the differing paints.

A still further object is to develop a lateral exhaust manifold system which produces a turbulent flow of air laterally across the preheat section of a production tunnel kiln and which vents the contaminated air through a longitudinal duct having a blower attached to one end of the duct.

It is an object of this invention to produce a lateral exhaust manifold system which will effectively and efficiently remove the contaminated atmosphere of the preheat section of a tunnel kiln such that the number of rejects from the cross-contamination of different type of paints is substantially reduced to increase the quality of the paints and productivity.

Finally, it is an object of this invention to produce an effective venting system for production kilns that will improve the consistency of fired resistance values, and thereby lead to correspondingly improved temperature coefficient of resistance values and a correspondingly improved consistency of temperature coefficient of resistance tracking values.

In accordance with this invention, generally stated, mounted in the preheat section of a production tunnel kiln are a longitudinal duct and input tube. Compressed air passes through the input tube and is expelled laterally and vertically to create a turbulent air flow laterally across the preheat section of the kiln. The contaminant laden air is captured by cones disposed about apertures in the longitudinal duct on the other side of the preheat section, and is drawn into the duct. A blower attached to one end of the duct vents air from the duct thereby creating a partial vacuum in the duct which draws the contaminant laden air into the duct through the cones. Air curtains prevent outside atmosphere from entering the preheat section at either the entrance or exit.

DRAWINGS

FIG. 1 is a partially cut-away isometric view of the lateral exhaust manifold system mounted in the preheat section of a production tunnel kiln;

FIG. 2 is a section view along lines 2—2 of FIG. 1 showing the lateral exhaust manifold duct and input tube and turbulent flow of air laterally and vertically in the kiln section.

FIG. 3A is a section view of the inlet air curtain along lines 3A—3A of FIG. 1.

FIG. 3B is a cut-away top view of the inlet air curtain.

DETAILED DESCRIPTION OF THE INVENTION

A typical production tunnel kiln includes a preheat section and firing section with a continuous conveyer belt moving longitudinally throughout. Substrates on boards positioned on the conveyor belt enter the preheat section by passing through an air curtain which prevents outside atmosphere from entering the kiln, and wet paints on the substrates are raised to a temperature in the preheat section sufficient to cause volatile organics to escape from the paints. The substrates then pass through an air curtain at the exit of the preheat section. The paint is next heated to a higher temperature in the succeeding firing section which removes the remaining volatile matter and fires the paint. Referring now to FIGS. 1 and 2, the preheat section of a production tunnel kiln is designated generally by reference numeral 10 and contains the lateral exhaust manifold system designated generally by reference numeral 12 comprising a lateral exhaust manifold 14, an air input tube 16, an inlet air curtain 50, and an outlet air curtain (Not shown). Air input tube 16 extends longitudinally into section 10 along wall 18 of the kiln and has a plurality of air jets designated generally be reference numeral 20 spaced at intervals therealong. The air jets 20 consist of apertures 22 accurately drilled in the tube in order to perform the function of directing each air jet toward a particular area on the other side of the kiln preheat section. The apertures 22 are positioned such that they form an angle with the base wall 24 of the kiln because the apertures are positioned upwardly towards the lateral exhaust manifold 14 on the other side of the preheat section 10. At spaced intervals, intermediate the air jets 20, are a plurality of planar auxilary air apertures 26 positioned in the same plane as apertures 22. Directly behind the planar auxilary air apertures 26 in the input tube 16 are auxilary air apertures 30 each being approximately 90 degrees out-of-phase with a respective planar auxilary air aperture 26. It is an important feature of this invention that turbulent air flow be created throughout the preheat section of the production kiln, not only where the air jets 20 are positioned but also therebetween in order to have turbulent flow throughout rather than at spaced intervals along the preheat section. This is accomplished by the planar auxilary air apertures 26 and auxilary air apertures 30 which, as will hereafter be described, serve to create turbulent air flow along the wall 18 and laterally across the preheat section in the areas between the air jets 20.

Disposed opposite the air input tube 16 is the lateral exhaust manifold 14 comprising a generally triangular shaped longitudinal duct 32 having a plurality of spaced apart apertures 34 positioned therealong. Disposed within the duct 32 are a plurality of cones 36 having the large diameter end of each cone circumposing a respective aperture 34, the cones pointing inwardly of the duct, and the smaller diameter end or cone aperture 38 being positioned near or adjacent the duct wall 40. It is an important feature of this invention that each spaced apart cone 36 and respective circumposed aperture 34 be disposed opposite a respective air jet 20, the air jet, as before described, being directed upwardly at an angle from the base wall 24 of the kiln in a line-of-sight (see dashed lines in FIGS. 1 and 2) from the respective aperture 22 to the oppositely disposed cone aperture 38. At one end of the longitudinal duct 32 is an exhaust stack 42 which is connected to an adjustable exhaust blower 44. The function of the adjustable exhaust blower 44 and the stack 42 is to vent atmosphere from the duct thereby creating a partial vacuum within the longitudinal duct 32, for a purpose to be described. At the entrance to the preheat section 10 is the inlet air curtain 50 and the outlet air curtain (not shown) is located at the exit end of the preheat section. As shown in FIGS. 1 and 3, the air curtains are generally box shaped with compressed air entering the chamber 51 through feed pipes 52, 54 branching from source pipe 55, the compressed air being vented downwardly through a plurality of curtain apertures 58. Some air curtains also utilize baffles to assist in directing the flow of the compressed air. The purpose of the inlet and outlet air curtains is to reduce or wholly prevent the flow of any air or ambient gases from outside the kiln into the kiln preheat section and thereby accomplish effective isolated control of the atmosphere in the preheat section by the input tube 16 and longitudinal duct 32. The air curtains may receive compressed air from the same input source that supplies compressed air to input tube 16.

Conveyor belt 60 passes longitudinally through the air curtain 50 into the preheat section 10, and then exits the opposite end through the outlet air curtain (not shown). Carried on the conveyor belt 60 is a plurality of boards or setters 70 each supporting a number of substrates containing paints thereon. The function of the preheat section 10 is to boil off i.e., remove volatile organic and nonorganic material from the paints prior to the paints entering a firing section of the production tunnel kiln. As previously described, the prior art has attempted a number of methods to remove the contaminated atmosphere that results from the emission or escape of volatile organic material from the paints. The prior art has used counter-flow or co-flow methods or simply the removal of substrates from a number of boards in order to present gaps between classes of different paints so that the preheat section would have a time during which contaminated atmosphere from heating of one class of paints could be vented prior to the entry of a new type of paint, thereby preventing cross-contamination from differing paints.

The preferred embodiment of the lateral exhaust manifold system is as shown in FIGS. 1 and 2 and is installed in a standard production tunnel kiln comprising an approximate 15 foot preheat section 10 and a 15 foot firing section (not shown). The lateral exhaust manifold 14 is approximately 12 foot in length and the air input tube 16 of a corresponding length. The exhaust blower 44 should be an adjustable exhaust blower such that a partial vacuum can be created within the longitudinal duct 32, the purpose being to induct contaminated atmosphere moving laterally across the preheat section 10 into the cones 36 and into the longitudinal duct 32 through cone apertures 38, then drawn through the exhaust stack 42 and thereafter vented by the blower 44. It is an important feature of this invention that the lateral exhaust manifold system be in balance, that is certain parameters must be determined such that the system will operate at an optimum level in order to obtain the objects of the invention previously described. The factors that are of critical importance in balancing the lateral manifold exhaust system are the air flow of the air curtains, the air velocity at the air jets 20, the air flow rate across the preheat section, the air velocity at the cone apertures 38, the vacuum pressure within the longitudinal duct 32, and the air velocity in the longitudinal duct 32. A proper balancing of these critical factors, as will be described, is necessary in order to obtain proper functioning of the lateral exhaust manifold system and thereby increase the yield and quality of the paints passing through the production tunnel kiln. A proper balancing of the described critical factors can produce a 3 to 6 percent improvement in product yield. There are of course other benefits to the invention in the way of better and more uniform products.

OPERATION

In operation, compressed air passes through air input tube 16 and exits from air jets 20, planar auxilary air apertures 26, and auxilary air apertures 30, into the preheat section 10 of the production tunnel kiln. The pressurized air exits the jets and apertures at a velocity of approximately 4,500 feet per minute. The velocity of the air creates turbulent air flow as shown along the dashed lines in FIG. 2, laterally across the kiln and vertically and horizontally along the wall 18 and ceiling wall 19, respectively, thereby creating turbulent flow throughout the preheat section and leaving no gaps consisting of laminar flow. As shown in FIG. 2, as the air moves across the preheat section it is contaminated with volatile organic matter emitted from the paints and then the contaminated air is captured by the cones 36. The contaminated air passes through the cone apertures 38 into the longitudinal duct section 32, drawn therein by the partial vacuum created within the longitudinal duct by the adjustable exhaust blower 44. The partial vacuum is approximately 0.33 inches of water vacuum pressure and creates an air flow of approximately 1,100 feet per minute at the cone apertures 38 and an air flow of approximately 100 feet per minute longitudinally through the duct 32. Thus, the air moves laterally across the preheat section at a flow rate of approximately one cubic foot per minute and is drawn into the duct, passes longitudinally through the duct, and is vented through the exhaust stack 42. The inlet air curtain 50 and the outlet air curtain (Not shown) each produce an air flow of approximately $1\frac{1}{2}$ cubic feet per minute at the entrance and exit portions of the preheat section to thereby block the entrance of any atmosphere into the kiln.

The lateral exhaust manifold system, as described, can produce an increase in the yield capacity of the production tunnel kiln. This is a result of the ability of the preheat section to vent contaminated air such that boards containing different paints can be placed adjacent one another. The effective venting of the contaminant laden atmosphere from the preheat section substantially reduces the cross-contamination from differing paints and results in not only a higher and qualitatively better yield but a savings in energy costs. It is also foreseen the lateral manifold exhaust system can be utilized for similar purposes in the firing section of a production tunnel kiln.

The lateral exhaust manifold also lends to a more accurate tracking of the temperature coefficient of resistance (TCR) of fired resistance materials because of an increased consistency in the fired resistance values. For example, if two substrates having resistance paints thereon are dried and fired in a kiln not fitted with the lateral exhaust manifold system, the contaminant laden atmosphere in the preheat secton can result in the paints having different resistance values after sintering in the firing section of the kiln. The resistance values of the fired resistors are adjusted easily to the desired or specified resistance value by abrading or laser trimming but the TCR of each resistor is dependent upon the fired resistance value not the abraded or trimmed resistance value. In other words, abrading or trimming the resistors cannot substantially modify or alter the individual TCR's of the fired resistors because the temperature coefficient of resistance is dependent upon the respective fired resistance value. Manufacturers are presently receiving product orders that require not only an overall specified fired resistance value but which specify that the resistors have TCR and TCR tracking values that fall within specified ranges. As there is an improved control of the spread of fired resistance values, there tends to be an improved control of TCR values with or without abrading or trimming, and a corresponding improvement in the control of TCR tracking values. Therefore, in order to accurately track the TCR value of fired resistors, it is necessary to obtain an improved consistency of fired resistance values. The lateral manifold exhaust system not only improves product yield capacity but improves the quality and consistency of fired resistance values, thereby lending to improved control of TCR and TCR tracking values.

CONCLUSION

Although the present invention has been illustrated and described in connection with a single example embodiment, it will be understood that this is illustrative of the invention, and it is by no means restrictive thereof. It is reasonably to be expected that those skilled in the art can make numerous revisions and additions of the invention and it is intended that such revisions and additions will be included within the scope of the following claims as equivalents of the invention.

What is claimed as new and desired to be secured by Letters Patent of the United States is:

1. A lateral exhaust manifold system for purging contaminated atmosphere from a kiln, comprising a longitudinal duct disposed on one side of a kiln and having a plurality of spaced apart apertures, a plurality of cones each having a large diameter end circumposing a respective aperture, an exhaust means connected to said duct, a longitudinal input tube disposed opposite and laterally across said kiln from said longitudinal duct and having spaced apart jets disposed oppositely from said apertures means for forcibly emitting a medium under pressure from said jets whereby said medium moves laterally and turbulently across said kiln which is maintained under slight superatmospheric pressure, said contaminated air being vented together with contaminants through said cones spaced along the length of said kiln and said longitudinal duct by the exhaust means, and a gaseous barrier disposed at the entrance and exit of said kiln to prevent external atmosphere from entering said kiln.

2. The lateral manifold exhaust system of claim 1 wherein a plurality of spaced apart apertures are each disposed between a pair of said jets.

3. The lateral manifold exhaust system of claim 1 or 2, wherein a plurality of apertures are each disposed between a pair of said jets and disposed in a different plane.

4. The lateral manifold exhaust system of claim 1, wherein the exhaust means comprises a blower connected to one end of the longitudinal duct.

5. A process for continuously removing contaminated atmosphere from a kiln by sweeping transversely therein, comprising the steps of forcibly feeding a compressed medium into a longitudinal input carrier disposed along one side of the kiln, the compressed medium venting from a plurality of spaced apart openings in said carrier to create a slightly superatmospheric pressure within the kiln and to develop a continuous flow laterally and turbulently across said kiln, maintaining a continuous feed pressure to said carrier, and continuously drawing the entrained medium and contaminants into a carrier disposed along the laterally opposite side of said kiln and then venting the contaminated medium.

6. The process in accordance with claim 5, in which the kiln is heated to a temperature sufficient to remove volatile organics from paints continuously moving through the kiln with said organics being continuously removed through the carrier.

7. The process in accordance with claim 5, in which the kiln is heated to a temperature sufficient to boil off volatile matter from undried material and effectively withdrawing the volatile matter prior to exposure to successive undried material.

8. The process in accordance with claim 5, in which the compressed medium escapes across entrance and exit openings of said kiln to provide a barrier to the flow of any external atmosphere into the kiln.

9. The process in accordance with claim 8, in which the flow of escaping compressed medium, the lateral flow of the medium, and the drawing and venting of the medium are maintained at continuous rates.

10. A process for continuously removing contaminants from kilns comprising the steps of: continuously passing through a sealed preheat section of the kiln a flow of products with painted surfaces which upon heating develop gasification of a portion of the paint, introducing air under pressure at spaced locations along the length of the section and in a direction transverse to the flow of products to turbulently sweep said product and to maintain such section under superatmospheric pressure, entraining the gasified contaminants within the turbulent flow of air, collecting the air and entrained gaseous contaminants, and removing said air and contaminants to preclude their contamination of painted surfaces of subsequent products.

* * * * *